US008029907B2

(12) United States Patent
Kurze et al.

(10) Patent No.: US 8,029,907 B2
(45) Date of Patent: Oct. 4, 2011

(54) PRODUCTION OF WEAR-RESISTANT LAYERS ON BARRIER-LAYER-FORMING METALS OR THEIR ALLOYS BY MEANS OF LASER TREATMENT

(75) Inventors: Peter Kurze, Nideggen (DE); Hermann H. Urlberger, Ratlingen (DE); Jürgen Koch, Amberg (DE)

(73) Assignee: AHC Oberflachentechnik GmbH, Kerpen (DE)

( * ) Notice: Subject to any disclaimer, the term of this patent is extended or adjusted under 35 U.S.C. 154(b) by 670 days.

(21) Appl. No.: 11/978,422

(22) Filed: Oct. 29, 2007

(65) Prior Publication Data

US 2008/0102298 A1 May 1, 2008

(51) Int. Cl.
*B32B 9/00* (2006.01)

(52) U.S. Cl. ..... 428/469; 428/472

(58) Field of Classification Search ..... None
See application file for complete search history.

(56) References Cited

U.S. PATENT DOCUMENTS 4,695,329 A * 9/1987 Hayashi et al. ..... 148/549
5,101,879 A * 4/1992 Beck et al. ..... 164/98
5,811,194 A 9/1998 Kurze et al. ..... 428/469
6,837,299 B2 * 1/2005 Schlienger et al. ..... 164/122.2

* cited by examiner

*Primary Examiner* — Timothy Speer
(74) *Attorney, Agent, or Firm* — Woodard Emhardt Moriarty McNett & Henry LLP

(57) ABSTRACT

Disclosed is a method for producing wear-resistant layers on materials of barrier-layer-forming metals, such as aluminum, magnesium and titanium and their alloys and mixtures, preferably aluminum or its alloys, by means of laser treatment, the material surface being exposed to a laser irradiation in the presence of an atmosphere containing oxygen in such a way that the upper or outer layer of the material surface reacts with the oxygen to form an oxide of the metal constituting the material, preferably aluminum oxide, and the layer of the material lying under that is remelted without reacting with the atmosphere containing oxygen. This results in a multilayer structure with excellent wear-resistant properties, including excellent corrosion resistance, excellent abrasion resistance and extreme hardness that does not exhibit any brittleness as a result of the hardness gradient within the layer structure.

22 Claims, 1 Drawing Sheet

PRODUCTION OF WEAR-RESISTANT LAYERS ON BARRIER-LAYER-FORMING METALS OR THEIR ALLOYS BY MEANS OF LASER TREATMENT

CROSS REFERENCES TO RELATED APPLICATIONS

This application claims priority to German Patent Application No. DE 10 2006 051 709.1, filed Oct. 30, 2006, entitled "PRODUCTION OF WEAR-RESISTANT LAYERS ON BARRIER-LAYER-FORMING METALS OR THEIR ALLOYS BY MEANS OF LASER TREATMENT", which is expressly incorporated by reference herein, in its entirety.

BACKGROUND OF THE INVENTION

The present invention relates to a method for producing wear-resistant layers on materials of barrier-layer-forming metals, such as in particular aluminum, magnesium and titanium and their alloys and mixtures, by means of laser treatment and to the application of this method and to the materials provided with wear-resistant layers produced in this way.

The production of wear-resistant layers on materials of barrier-layer-forming metals, such as aluminum, magnesium and titanium and their alloys, under electrolytic conditions is known: for instance, wear-resistant layers with excellent properties can be obtained by what is known as anodic oxidation with spark discharge (known as the ANOF method) and suitable, usually aqueous or aqueous-organic electrolyte solutions. Such a method is described for example in EP 0 545 230 B1. A disadvantage of these methods is that they work electrolytically and therefore use electrolyte baths, which subsequently require disposal. What is more, after their production, the layers produced must be cleaned of undesired constituents of the electrolyte bath. Therefore, efforts are increasingly being made to produce such wear-resistant layers in some other way.

The multitude of applications for surface refinement in automobile construction and other areas, in particular in the area of mechanical engineering, is sufficient testimony to the need for technologies that meet the increased requirements for the functionality of the components. Laser methods offer new approaches here to improving the quality of the components. However, wear-resistant layers have a leading role to play. In principle, the use of lasers for surface treatment opens up new environmentally friendly technologies, in particular since they do not need electrolyte baths.

In DE 102 02 184 C1 and the journal HTM 52 (1997) 2, pages 91 to 93 (J. Barnikel et al. "Nitrieren von Aluminiumlegierungen mit UV-Laserstrahlung" [nitriding of aluminum alloys with UV laser radiation], comments are made on the laser nitriding of aluminum surfaces.

For instance, DE 102 02 184 C1 describes a method for producing wear-resistant layers in regions of components that are near the surface, in particular pistons for internal combustion engines, from a composite aluminum base material, at least parts of the surface of the components having undergone hardening and the wear-resistant layer being formed from aluminum nitrides in an aluminum matrix, the wear-resistant layer being produced by means of a laser nitriding treatment, with energy being introduced into the surface in the form of pulses, so that a remelt layer forms in the areas near the surface and this causes a conversion of nitrogen from the nitrogen atmosphere or from the air with aluminum from the composite material in such a way that the aluminum nitrides are in a finely dispersed and graded form in the remelt layer.

Although the aluminum nitride (AlN) formed in this way is very hard (about 1230 HV=Vickers hardness), it is also very brittle. It therefore tends to crack and is consequently unusable for many applications, in particular in automobile construction. Particularly safety components that are exposed to vibrations, such as for example aluminum components for internal combustion engines, such as in particular pistons, cylinder faces, valves and the like, are at great risk if they are provided with such an aluminum nitride layer. The use of such components provided with aluminum nitride layers can cause the entire engine to fail while it is running. The layer thickness of the aluminum nitride layer produced is also relatively small. Moreover, under point loading of the surface there occurs an effect known as the "eggshell effect": the base material under-goes plastic deformation and this causes subsequent crack formation.

The technical teaching of DE 102 02 184 C1 also does not overcome the aforementioned disadvantages, even if the energy of the laser is applied to the aluminum surface in a pulsed manner in a nitrogen atmosphere and the aluminum nitride is formed in a finely dispersed manner.

A further possibility for surface refinement by means of laser treatment is that of producing aluminum materials by the laser treatment of protective oxide-ceramic layers, the material particles, such as for example aluminum oxide ($Al_2O_3$), zirconium oxide ($ZrO_2$) etc., being melted onto the surface of the aluminum material (cf. Laser und Optoelektronik, 29(4), pages 48 to 52, 1997). The disadvantage of this possibility in principle of melting solid materials by laser and applying them to the material surfaces concerned is that these particles cannot be applied uniformly to the surface of the material. In particular in the case of components of a complicated shape, uniform coating cannot be accomplished. Furthermore, poor bonding of the melted particles with respect to the material surface is often observed, which is often caused by an already existing oxide layer on the workpiece to be treated.

The problem on which the present invention is based is therefore that of providing a method for producing wear-resistant layers on materials of barrier-layer-forming metals, in particular aluminum, magnesium and titanium and their alloys and mixtures, which largely avoids, or at least mitigates, the disadvantages of the prior art described above.

To solve the problem described above, the present invention proposes—according to a first aspect of the present invention—a method as claimed in claim 1. Further, particularly advantageous refinements of the method according to the invention are the subject of the respective method subclaims.

This is so since the applicant has now surprisingly found that the problem described above can be solved by exposing the material surfaces of materials based on barrier-layer-forming metals, such as aluminum, magnesium and titanium and their alloys and mixtures, to a laser treatment in the presence of an atmosphere containing oxygen, or laser irradiation in the form of a laser oxidation treatment, in such a way that the upper or outer layer of the material surface is exposed to the oxygen to form an oxide of the metal constituting the material, while the layer of the material lying under that is remelted without reacting with the oxygen.

Further subject matter of the present invention—according to a second aspect of the present invention—is the application according to the invention of the method based on the present invention, as it is defined in the respective claims.

Finally, subject matter of the present invention—according to a further, third aspect of the present invention—is the materials according to the present invention that can be obtained by the method according to the invention, which are provided with a wear-resistant layer of the aforementioned type and as defined in the respective claims.

The subject matter of the present invention is consequently—according to a first aspect of the present invention—a method for producing wear-resistant layers on materials of barrier-layer-forming metals, in particular aluminum, magnesium and titanium and their alloys and mixtures, with preference aluminum or its alloys, by means of laser treatment, the material surface being exposed to a laser irradiation in the presence of an atmosphere containing oxygen in such a way that the upper or outer layer of the material surface is reacted or converted with the oxygen of the atmosphere containing oxygen to form an oxide of the metal constituting the material, while the layer of material lying under that is remelted without reacting with the oxygen.

The laser treatment or laser oxidation according to the invention results in wear-resistant layers with excellent wear-resistant properties, in particular with excellent corrosion resistance and excellent abrasion resistance and extreme hardness, the wear-resistant layers not exhibiting any brittleness—unlike aluminum nitride layers of the prior art—and, because of the hardness gradient within the layer structure—the hardness (Vickers hardness) of the layers or the layer structure decreasing gradually from the outside inward—exhibiting excellent mechanical properties, in particular not having a tendency toward the "eggshell effect" under point loading of the surface.

The layers produced according to the invention have properties that are comparable, or to some extent improved, in comparison with wear-resistant layers produced according to conventional electrolytic methods, with disadvantages being avoided in an efficient way, in particular by avoiding the use of electrolyte baths.

The laser treatment or laser oxidation carried out according to the invention results in a multilayer structure: the actual wear-resistant layer as such generally comprises a two-layer structure, this comprising the upper or outer oxide layer of the metal constituting the material and the layer of remelted material ("remelt layer") lying adjacent the upper or outer oxide layer and lying under this oxide layer, arranged underneath which there is then the unchanged (i.e. unreacted and not remelted) layer of the material adjacent said remelt layer. Altogether, it therefore results in a multilayer structure which comprises—when viewed from the outside inward or from top to bottom—the upper, outer oxide layer of the metal constituting the material, the remelt layer arranged under that and the layer of unreacted and not remelted base material arranged in turn under that. In this case, the outer layer (i.e. the oxide layer of the metal constituting the material) has the greatest hardness (Vickers hardness), the remelt layer lying under that has a lower hardness (Vickers hardness) in comparison, and the layer of the base material arranged in turn under that has the lowest hardness (Vickers hardness). This produces as desired a multilayer structure with the aforementioned hardness gradient, which leads to excellent mechanical properties.

According to one particular embodiment of the method according to the invention, it may be provided that, before the production of the wear-resistant layer (i.e. before the laser treatment or laser oxidation according to the invention), the material surface is subjected to a remelting, in particular likewise by means of laser treatment, with preference under inert conditions. When doing so, it must be ensured in particular that no oxidation of the material surface takes place during this pretreatment. This is achieved by working under inert conditions, in particular under an inert gas atmosphere, prefera-bly under a noble gas atmosphere, and below the reaction temperatures of the material surface, generally below temperatures of 1.000° C. of the material surface. However, this preceding method step of remelting is of a purely optional nature.

According to a preferred embodiment, aluminum or an aluminum alloy is used in particular as the metal constituting the material, so that an aluminum oxide layer ($Al_2O_3$ layer) results as the upper, outer layer of the laser treatment or laser oxidation according to the invention. The material according to the invention may be, for example, a cast or diecast material, in particular an aluminum cast or diecast material. In particular, it may be a coarse-grained cast or diecast material, in particular cast or diecast aluminum material, which may possibly have been subjected to a remelting, in particular likewise by means of laser treatment, as described above, before the production of the wear-resistant layer by the laser treatment according to the invention, this pretreatment being optional. Instead of cast or diecast alloys, wrought alloys, in particular wrought aluminum alloys, may also be subjected to the treatment according to the invention. However, the aforementioned examples of materials used are not of a restrictive nature.

In principle, a laser with a wavelength in the range from 700 to 1.200 nm, in particular 800 to 1.100 nm, is used for the laser treatment according to the invention.

In principle, both pulsed and nonpulsed lasers may be used for the laser treatment or laser oxidation according to the invention. In the case of the use of pulsed lasers, the pulse duration (FWHM) is chosen in particular in the range from $10^{-7}$ s to $10^{-2}$ s, in particular at approximately $10^{-3}$ s; the layer thickness of the wear-resistant layer can be controlled in a specifically selective manner by means of the pulse duration of the laser.

For example, a nonpulsed diode laser or an Nd:YAG laser, in particular respectively at a wavelength in the range from 800 to 1100 nm, may be used within the scope of the method according to the invention.

Generally, the laser treatment is carried out in such a way, in particular the energy that is introduced or made to act by means of laser irradiation is dimensioned in such a way, that the reaction temperature $T_{reaction}$ at the material surface is at least 1.000° C. ($T_{reaction} \geqq 1.000°$ C.).

Generally, the power density used for the laser may vary within broad ranges. For ex-ample, the power density used for the laser may be chosen in the range from $10^4$ to $10^8$ W/cm$^2$, in particular in the range from $10^5$ to $10^7$ W/cm$^2$, preferably at approximately $10^6$ W/cm$^2$. Nevertheless, it may be necessary owing to the individual case or on the basis of the application to deviate from the aforementioned values without departing from the scope of the present invention.

As described above, the laser treatment or laser oxidation according to the invention is carried out in an atmosphere containing oxygen. The atmosphere containing oxygen may either comprise or consist of pure oxygen or comprise or consist of a gas mixture of oxygen with at least one further inert gas that is nonreactive under reaction conditions, preferably a noble gas. In order that no nitrides, in particular no aluminum nitride, can be formed during the laser treatment or laser oxidation according to the invention, the atmosphere containing oxygen does not contain any nitrogen and/or any gas generating nitrogen under reaction conditions.

Generally, the method according to the invention is carried out under atmospheric pressure. Nevertheless, carrying out the method under reduced or increased pressure is not ruled out, even though it is preferred for the method to be carried out under atmospheric pressure.

Wear-resistant layers produced by the method according to the invention generally have total thicknesses of 50 to 350 μm, in particular 75 to 300 μm, preferably 100 to 250 μm. These thicknesses generally comprise the upper or outer oxide layer and the remelt layer lying under it.

As far as the upper or outer layer is concerned, which in the case of aluminum or aluminum alloys is an aluminum oxide layer ($Al_2O_3$ layer), possibly with further constituents (for example $SiO_2$ or mullite in the case of silicon-containing aluminum alloys), its layer thickness is generally 1 to 50 μm, in particular 2 to 30 μm, preferably 3 to 20 μm.

The upper, outer layer, in particular aluminum oxide layer ($Al_2O_3$ layer) has an extreme hardness. The Vickers hardness (HV) of this upper (outer) layer is at least 1.000 HV, in particular at least 1.500 HV, preferably at least 2.000 HV.

A further, particular feature of this upper, outer layer, in particular aluminum oxide layer ($Al_2O_3$ layer), is its extremely low roughness (peak-to-valley height): generally, the roughness (peak-to-valley height) $R_a$ of the upper, outer layer is ≦0.5 μm, in particular ≦0.4 μm, preferably ≦0.3 μm. Consequently, the wear-resistant layers produced according to the invention are also suitable for those applications in which the dimensional stability and evenness of the layers have to meet extremely high requirements.

In the event that the material consists of aluminum or an aluminum alloy, the upper, outer layer of the wear-resistant layer according to the invention is an aluminum oxide layer ($Al_2O_3$ layer) and comprises at least 60%, preferably at least 80%, with particular preference at least 90%, corundum ($\alpha$-$Al_2O_3$). This explains the extreme hardness of this outer layer. In the case of silicon-containing aluminum alloys, the outer layer may also contain up to 10%, in particular up to 20%, preferably up to 30%, silicon dioxide ($SiO_2$), preferably in the form of mullite; this likewise exhibits a great Vickers hardness. All the aforementioned figures in percent are given as percent by weight with respect to the weight of the upper, outer layer.

As far as the remelt layer is concerned, arranged under the outer oxide layer, in particular $Al_2O_3$ layer, it generally has a thickness in the range from 50 to 300 μm, in particular 75 to 250 μm, preferably 100 to 200 μm.

This remelt layer generally has a Vickers hardness (HV) that is less than the Vickers hardness (HV) of the outer layer lying above it and a Vickers hardness (HV) that is greater than the underlying layer of base material. Generally, the remelt layer arranged under the outer oxide layer, in particular under the outer $Al_2O_3$ layer, has a Vickers hardness (HV)≧150 HV, in particular ≧200 HV. The much lower Vickers hardness of the remelt layer in comparison with the outer oxide layer is explained by the fact that the remelt layer was created by the base material simply remelting, but not reacting with the oxygen of the laser treatment atmosphere; a greater Vickers hardness of the remelt layer in comparison with the underlying layer of the base material is in turn ex-plained by the fact that a finely dispersed or finely grained phase or layer is created by the remelting process.

This is so since the remelting process by means of laser treatment or laser oxidation according to the invention has the effect that the remelt layer arranged under the outer oxide layer, in particular under the outer $Al_2O_3$ layer, is formed in a finely dispersed and/or finely grained manner, in particular with a grain size <1 μm, preferably <0.5 μm.

By contrast, the base material lying under the remelt layer is generally formed in a coarsely grained and/or coarsely dispersed manner, in particular with a grain size >10 μm, preferably >20 μm.

As described above, the base material arranged under the remelt layer generally has a lower Vickers hardness than the remelt layer lying above it: generally, the Vickers hardness (HV) of the base material layer lying under the remelt layer is up to 150 HV, and lies in particular in the range from 50 to 150 HV, preferably 75 to 125 HV.

The basic layer structure of the wear-resistant layers obtainable by the method according to the invention is illustrated in the representations of the figures.

BRIEF SUMMARY

Disclosed is a method for producing wear-resistant layers on materials of barrier-layer-forming metals, such as aluminum, magnesium and titanium and their alloys and mixtures, preferably aluminum or its alloys, by means of laser treatment, the material surface being exposed to a laser irradiation in the presence of an atmosphere containing oxygen in such a way that the upper or outer layer of the material surface reacts with the oxygen to form an oxide of the metal constituting the material, preferably aluminum oxide, and the layer of the material lying under that is remelted without reacting with the atmosphere containing oxygen. This results in a multilayer structure with excellent wear-resistant properties, including excellent corrosion resistance, excellent abrasion resistance and extreme hardness that does not exhibit any brittleness as a result of the hardness gradient within the layer structure.

DETAILED DESCRIPTION

Figure 1:
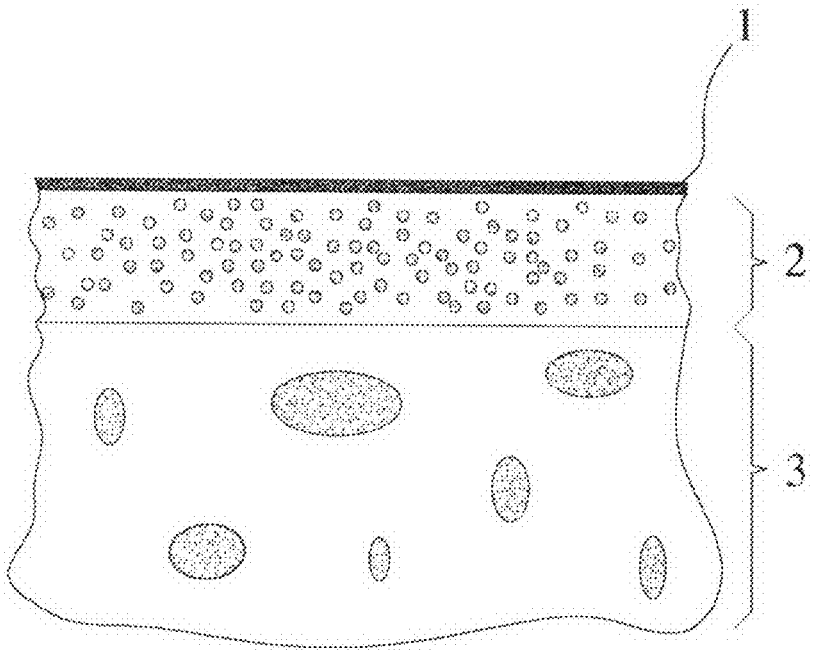
FIG. 1 shows a schematic sectional representation through the structure of a multilayer structure obtainable by the method according to the invention.

For the purposes of promoting an understanding of the disclosure, reference will now be made to the embodiments illustrated in the drawings and specific language will be used to describe the same. It will nevertheless be understood that no limitation of the scope of the disclosure is thereby intended, such alterations and further modifications in the illustrated device and its use, and such further applications of the principles of the disclosure as illustrated therein being contemplated as would normally occur to one skilled in the art to which the disclosure relates.

Figure 2:
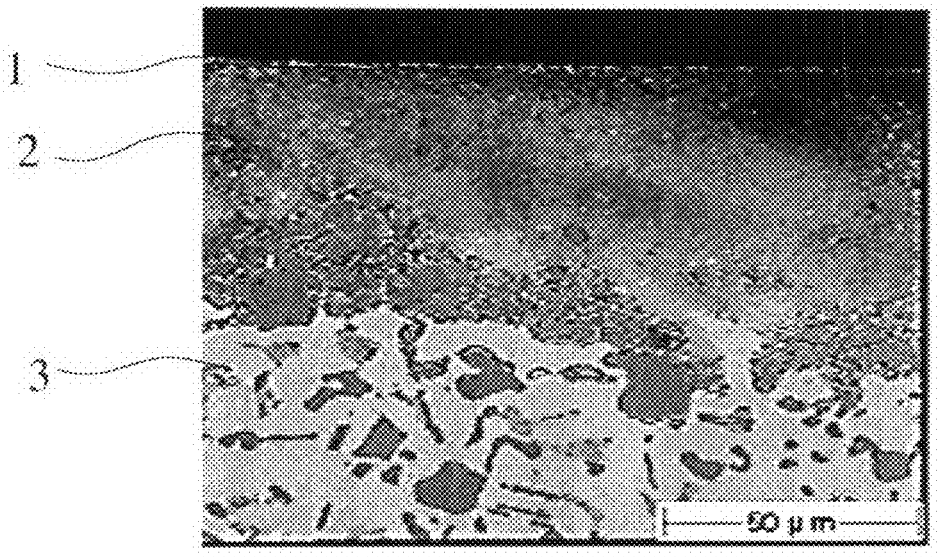
FIG. 2 shows a scanning electron microscope photo of a layer through the structure of a multilayer structure obtainable by the method according to the invention.

As can be seen from the presentations of the figures according to FIGS. 1 and 2, the method according to the invention results in a multilayer structure made up of the actual wear-resistant layer, which generally comprises a two-layer structure, this comprising the upper or outer oxide layer 1 of the metal constituting the material and the layer 2 of the remelted material ("remelt layer") lying adjacent the upper or outer oxide layer and lying under this oxide layer 1, arranged underneath which there is then the layer 3 of the material adjacent said remelt layer, the remelt layer 2 being formed in a finely grained or finely dispersed manner, while the unreacted material layer 3 by contrast is formed in a coarsely grained or coarsely dispersed manner. For further details of the individual layers and their structure and composition, reference can be made to the above comments.

According to one particular development of the present invention, the method according to the present invention may be carried out in a multistaged manner:

This may involve first carrying out, in a first method step, a simple remelting of the material surface, preferably in regions near the surface (to be precise, as described above, under inert or nonreactive conditions) and subsequently, in a second method step, producing or applying a corundum or corundum/mullite outer layer by the method according to the invention. The two method steps may be carried out one after the other. The same or different types of laser may be used for the two method steps. As described above, the first method step, the remelting, is generally carried out under inert conditions, without a chemical reaction of the material surface to form an oxide layer taking place; in this respect, to avoid unnecessary repetition, reference can be made to the comments made above.

As described above, the method according to the invention leads to wear-resistant layers with excellent corrosion resistances as well as excellent abrasion resistances and extreme hardnesses. The multilayer structure that results from the laser treatment or laser oxidation according to the invention also has no tendency to be brittle, so that the wear-resistant layers produced according to the invention are also suitable for components, in particular safety components, that are exposed to vibrations (for example aluminum components of internal combustion engines, such as pistons, cylinder faces, valves etc.).

According to a typical embodiment of the method according to the invention, the following procedure can be followed:

As described above, according to the invention the wear-resistant layer is formed on the material surface, in particular the aluminum surface, by means of laser oxidation in an atmosphere containing oxygen, the upper layer of the material surface, in particular in regions near the surface, reacting or being converted to form an oxide of the metal constituting the material, in particular aluminum oxide, and the layer lying under that being remelted and newly scaled, without reacting with the oxygen.

According to the invention, the laser treatment can also be used if only a certain region of the material or workpiece of the barrier-layer-foaming metals is to be selectively oxidized (for example only the annular groove of a piston for internal combustion engines). In this case, it is possible in particular to work with a nozzle that is directed at the location concerned and through which there flows reaction gas of oxygen or a mixture of oxygen/inert gas (oxygen-free!), as defined above. The distance of the nozzle from the base point of the laser beam should be, for example, at least 5 mm and, de-pending on the application, is, for example, at most 30 mm. The angle of incidence of the nozzle to the surface of the workpiece should be 60° to 95°. If pure oxygen is used, a volume flow on emerging from the nozzle of 5 l/min to 30 l/min can be set, for example.

The arrangement of using a nozzle for the laser oxidation according to the invention can be used, for example, for the working of grooves, such as for example the annular groove of an aluminum engine piston, or of bores. For example, it is possible by the laser oxidation according to the invention to produce the annular groove of an aluminum piston of G-AlSi12MgCuNi with a wear-resistant layer predominantly of corundum with a hardness of the upper layer of up to about 2000 HV and more and also a layer thickness of the upper layer of up to 15 μm and more and a roughness $R_a$ of 0.4 to 0.5 μm and an unmelted layer lying under that with a hardness of 150 to 200 HV. For this purpose, the aluminum engine piston to be coated may be turned in a clamping device and the laser directed onto the annular groove of the piston with the parameters described above. It is alternatively also possible to move the laser and to fix the tool or the material on which the wear-resistant layer is to be applied. The laser treatment generates very high temperatures above 1000° C. on the treated material surface, so that the barrier-layer-forming metal is melted and the upper layer reacts with the oxygen to form the corresponding oxide, whereas the layer lying under that is merely melted, without being able to react with the oxygen. With the formation of corundum ($\alpha$-$Al_2O_3$) in the case of aluminum-based materials, and possibly mullite ($SiO_2$) in the case of silicon-containing alloys, not only the temperature of the laser is decisive for the formation of the upper layer; rather, a very high level of heat is also generated by the strongly exothermal chemical reaction of the melted barrier-layer-forming metal, such as aluminum, titanium, magnesium etc., with the oxygen.

In the case of aluminum as the base material, the upper, outer layer comprises at least 60% aluminum oxide ($Al_2O_3$) in the corundum modification (see comments made above). Vickers hardnesses of up to about 2000 HV (0.1) and more are determined. This high hardness is attributable to the fact that corundum has been produced with preference as the high temperature form of the aluminum oxide. Radiographic measurements have shown that the corundum content varies in the range from 60% to 90% and is dependent in particular on the temperature introduced and/or the time of exposure to the laser.

In the case of Al alloys with high silicon contents, such as for example GD-AlSi12, GD-AlSi9Cu3, G-AlSi12MgCuNi, ADC 12 etc., not only corundum ($\alpha$-$Al_2O_3$) but also mullite ($SiO_2$), which is likewise very hard, is produced; here, Vickers hardnesses of up to about 1900 HV (0.1) and more are measured. It has been found from radiographic measurements that the content of mullite ($SiO_2$) is up to 30%, for example if the alloy GD-AlSi12 is used in the corundum matrix.

The upper layer has low roughnesses or peak-to-valley heights $R_a$. In the case of the use of aluminum materials, the corundum layer typically has a roughness $R_a$ of about 0.3 to 0.5 μm and a layer thickness of typically 1 to 50 μm, in particular 2 to 30 μm, prefera-bly 3 to 20 μm.

Both the heat of the laser and the heat from the exothermal reaction of the barrier-layer forming metal with the oxygen cause a high amount of energy to be introduced into the layer of barrier-layer-forming metal lying under that. In the case of the use of aluminum materials that have a coarse-grained structure, such as for example a cylinder face in an aluminum crankcase of GD-AlSi12 or an Al engine piston of G-AlSi12MgCuNi, a remelting of the coarse-grained structure with grain sizes of 10 to 20 μm to form a very fine-grained structure therefore takes place in the layer lying under that. In the case of Al materials, depending on the alloy used, the remelted layer has a Vickers hardness of typically 150 to 200 HV (in comparison with that, coarse-grained cast or diecast Al material has Vickers hardnesses of only 60 to 80 HV), is finely dispersed or finely grained and has, in particular, grain sizes of less than a 1 μm, preferably less than 0.5 μm.

In FIG. 1, the basic structure of the layer system described above is illustrated. In the scanning electron microscope photo according to FIG. 2, this multilayer structure of layers is represented in section.

The method according to the invention can be applied universally and can be tailored to the specific applications.

Further subject matter—according to a second aspect of the present invention—is consequently the application of the method according to the invention, as it is described in the respective claims.

For example, the method according to the invention can be applied for producing wear-resistant layers on mechanical engineering products, in particular those for automobile construction, for example for components of internal combustion engines, such as for example cylinders, cylinder barrels, pistons, camshafts, bucket tappets, valves, bearing points on connecting rods, etc.

Furthermore, the method according to the invention can be applied for example for producing wear-resistant layers on pistons of internal combustion engines, in particular for coating them at least partially, preferably at least in the region of the upper or upper-most annular groove of the pistons.

Furthermore, the method according to the invention can also be applied for example for producing wear-resistant layers on medical and medical engineering products.

With respect to the application according to the invention of the method based on the present invention—to avoid unnecessary repetition—reference can be made to the comments made above on the method according to the invention itself, which apply correspondingly with respect to its application according to the invention.

Finally, subject matter of the present invention—according to a third aspect of the present invention—are materials of barrier-layer-forming metals, in particular aluminum, magnesium and titanium and their alloys and mixtures, with preference aluminum or its alloys, the surfaces of which are provided with wear-resistant layers, as can be obtained by the method according to the invention described above.

In particular, subject matter of the present invention according to this aspect of the invention are materials of barrier-layer-forming metals, in particular aluminum, magnesium and titanium and their alloys and mixtures, with preference aluminum or its alloys, the surface of which is provided with a wear-resistant layer produced by means of laser treatment in the presence of an atmosphere containing oxygen, the upper, outer layer of the material surface comprising or being an oxide layer of the metal constituting the material, preferably aluminum oxide, and the layer lying under that comprising or being an unreacted, remelted layer of the material.

The wear-resistant layer produced according to the invention is generally a multilayer structure, in particular a two-layer structure, this multilayer structure comprising the upper, outer oxide layer of the metal constituting the material and the layer of remelted material ("remelt layer") lying adjacent the upper, outer oxide layer and lying under the oxide layer, arranged underneath which there is then the unreacted or unchanged layer of the material adjacent said remelt layer.

For further details with respect to the materials according to the invention—to avoid unnecessary repetition—reference can be made to the comments made above on the method according to the invention and its application, which apply correspondingly with respect to the materials according to the invention.

The representation of the figures described above according to FIG. 1 schematically shows a section through the structure of a material provided with a wear-resistant layer according to the invention by means of laser treatment: as can be seen from FIG. 1, the underlying material 3 consists of a coarse-grained or coarsely dispersed phase, arranged on which is the finely dispersed or fine-grained remelt layer 2, on which in turn the oxide layer 1 of the metal constituting the material is applied.

Further refinements, modifications and variations of the present invention are readily evident to and can be implemented by a person skilled in the art on reading the description, without departing from the scope of the present invention.

The present invention is illustrated on the basis of the following exemplary embodiment, which however is in no way intended to restrict the present invention.

EXEMPLARY EMBODIMENT/WORKING EXAMPLE

A cylinder of G-AlSi12MgCuNi with a diameter of 40 mm and a length of 60 mm is treated on the circumferential surface with an Nd:YAG laser (wavelength: 1.064 nm). The power density at the base point of the laser beam is set at $10^6$ W/cm$^2$. The cylinder is clamped in a device and rotated at 6 rpm. The circumferential surface of the cylinder is systematically scanned under rotation of the cylinder and simultaneous axial feeding of the laser, the degree of overlap of the laser traces being 30%.

The oxygen supply (atmosphere: pure oxygen) takes place by means of a nozzle coaxial with the laser beam at an angle of 60°. The distance of the nozzle from the base point of the impinging laser beam is 20 mm. Pure oxygen with a volume flow of 15 l/mm is used as the gas.

In a transverse section that corresponds to the representations of the figures according to FIGS. 1 and 2, the following layer structure is determined on the coated cylinder:

- upper layer: composition corundum ($\alpha$-$Al_2O_3$)>90%, Vickers hardness (HV): (2032±88) HV (0.01), thickness: (10±2) μm
- underlying remelt layer: fine-grained structure, Vickers hardness (HV): 180 HV, thickness: about 200 μm
- base material: coarse-grained structure, Vickers hardness (HV): 80 HV While the preferred embodiment of the invention has been illustrated and described in the drawings and foregoing description, the same is to be considered as illustrative and not restrictive in character, it being understood that all changes and modifications that come within the spirit of the invention are desired to be protected.

The invention claimed is:

1. A material including a barrier-layer-forming metal, the surface of which is provided with a wear-resistant layer, the material being obtained by a method comprising the following steps:

using laser treatment;

exposing a material surface to a laser irradiation in the presence of an atmosphere containing oxygen in such a way that a first layer of the material surface reacts with the oxygen to form an oxide of the metal constituting the material; and remelting a second layer of the material lying under said first layer, without reacting with the oxygen, wherein the first layer is an aluminum oxide layer ($Al_2O_3$ layer) and comprises at least 60% corundum (a-$Al_2O_3$) and wherein, in the case of silicon-containing aluminum alloys as the base material that is the material, the first layer also contains up to 10% silicon dioxide ($SiO_2$) in the form of mullite.

2. The material of claim 1, wherein the barrier-layer-forming metal is selected form the group consisting of aluminum, magnesium and titanium and their alloys and mixtures.

3. The material of claim 1, wherein the wear-resistant layer produced is a multilayer structure, the multilayer structure comprising the first oxide layer of the metal constituting the material and the second layer of remelted material (remelt layer) lying adjacent the first oxide layer and lying under the oxide layer, arranged underneath which there is a third layer of the material adjacent said remelt layer.

4. The material of claim 1, wherein, as part of the obtaining method, before the production of the wear-resistant layer, the material surface has been subjected to a remelting by means of laser treatment under inert conditions.

5. The material of claim 1, wherein a laser with a wavelength in the range from 700 to 1200 nm is used and wherein a nonpulsed diode laser or an Nd:YAG laser is used as the laser.

6. The material of claim 1, wherein the laser treatment is carried out in such a way and the energy that is introduced by means of laser irradiation is dimensioned in such a way that the reaction temperature $T_{reaction}$ at the material surface is at least 1000° C. ($T_{reaction} \geqq 1000°$ C.).

7. The material of claim 1, wherein the density used for the laser is chosen in the range from $10^4$ to $10^8$ W/cm$^2$.

8. The material of claim 1, wherein the atmosphere containing oxygen comprises pure oxygen or comprises a gas mixture of oxygen with at least one inert gas that is nonreactive under reaction conditions.

9. The material of claim 1, wherein the wear-resistant layer produced has a total thickness of 50 to 350 μm.

10. The material of claim 1, wherein the first layer has a layer thickness of 1 to 50 μm.

11. The material of claim 1, wherein the first layer has a Vickers hardness (HV) of at least 1000 HV.

12. The material of claim 1, wherein the first layer has a roughness (peak-to-valley height) $R_a \leqq 0.5$ μm.

13. The material of claim 1, wherein the remelt layer arranged under the first oxide layer has a thickness of 50 to 300 μm.

14. The material of claim 1, wherein the remelt layer arranged under the first oxide layer has a Vickers hardness (HV)≧150 HV and wherein the remelt layer arranged under the upper (outer) oxide layer has a Vickers hardness (HV) that is greater than the Vickers hardness (HV) of the underlying layer of base material.

15. The material of claim 1, wherein the remelt layer arranged under the first oxide layer is finely dispersed or finely grained with a grain size <1 μm and wherein the base material lying under the remelt layer is coarsely grained or coarsely dispersed with a grain size >10 μm.

16. The material of claim 1, wherein the method is carried out in a multistaged manner, involving first carrying out, in a first method step, a simple remelting of the material surface in regions near the surface, and subsequently, in a second method step, producing or applying a corundum or corundum/mullite outer layer, with the method steps being carried out one after the other and with different types of laser.

17. The material of claim 1, wherein the obtaining method is applied for producing wear-resistant layers on mechanical engineering products.

18. The material of claim 17, wherein the mechanical engineering products are selected from the group consisting of those of automobile construction, components of internal combustion engines, cylinders, cylinder barrels, pistons, camshafts, bucket tappets, valves and bearing points on connecting rods.

19. The material of claim 1, wherein the obtaining method is applied for producing a wear-resistant layer on a piston of an internal combustion engine.

20. The material of claim 1, wherein the obtaining method is applied for producing a wear-resistant layer on a medical product.

21. A material including a barrier-layer-forming metal, the surface of which is provided with a wear-resistant layer produced by means of laser treatment in the presence of an atmosphere containing oxygen, wherein the wear-resistant layer is structured in a multilayered manner and comprises an first layer and a layer lying under that, the first layer of the material surface comprising or being an oxide layer of the metal constituting the material and the layer lying under that comprising or being an unreacted, remelted layer of the material, wherein the first layer is an aluminum oxide layer ($Al_2O_3$ layer) and comprises at least 60% corundum (a-$Al_2O_3$) and wherein, in the case of silicon-containing aluminum alloys as the base material that is the material, the first layer also contains up to 10% silicon dioxide ($SiO_2$) in the form of mullite .

22. The material of claim 21, wherein the wear-resistant layer produced comprises a multilayer structure, the multilayer structure comprising the first (oxide) layer of the metal constituting the material and the second layer of remelted material (remelt layer) lying adjacent the first (oxide) layer and lying under the first (oxide) layer, arranged underneath which there is a third layer of material adjacent said second (remelt) layer.

* * * * *